US008764133B2

(12) United States Patent
Park et al.

(10) Patent No.: US 8,764,133 B2
(45) Date of Patent: Jul. 1, 2014

(54) REFRIGERATOR

(75) Inventors: Jae Yong Park, Ulsan (KR); Hyun Tae Chu, Gwangju (KR); Hyoung Suk Lee, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/413,051

(22) Filed: Mar. 6, 2012

(65) Prior Publication Data

US 2012/0235551 A1 Sep. 20, 2012

(30) Foreign Application Priority Data

Mar. 17, 2011 (KR) ..... 10-2011-0023964

(51) Int. Cl.

| | |
|---|---|
| ***A47B 88/00*** | (2006.01) |
| ***A47B 81/00*** | (2006.01) |
| ***A47B 97/00*** | (2006.01) |
| ***A47B 96/04*** | (2006.01) |
| ***E05D 5/06*** | (2006.01) |

(52) U.S. Cl.

USPC ..... 312/324; 312/223.6; 312/405; 312/328; 16/389

(58) Field of Classification Search

USPC ..... 312/405, 405.1, 324, 223.6, 319.2, 236, 312/329–329, 326–329; 248/291.1, 213.1; 62/377, 248; 16/382, 387, 389, 309, 16/312, 315

See application file for complete search history.

(56) References Cited

U.S. PATENT DOCUMENTS

| | | | | | |
|---|---|---|---|---|---|
| 4,170,391 | A | * | 10/1979 | Bottger | 312/405 |
| 4,548,049 | A | * | 10/1985 | Rajgopal | 62/275 |
| 4,558,503 | A | * | 12/1985 | Wilson | 29/446 |
| 4,864,691 | A | * | 9/1989 | Gidseg et al. | 16/312 |
| 5,408,725 | A | * | 4/1995 | Wolanin | 16/239 |
| 5,694,789 | A | * | 12/1997 | Do | 62/441 |
| 5,787,724 | A | * | 8/1998 | Pohl et al. | 62/389 |
| 5,941,619 | A | * | 8/1999 | Stieben et al. | 312/223.6 |
| 6,058,565 | A | * | 5/2000 | Jeong | 16/382 |
| 6,935,712 | B2 | * | 8/2005 | Reed et al. | 312/405 |
| 7,108,342 | B2 | * | 9/2006 | Shin et al. | 312/405 |
| 2006/0125361 | A1 | * | 6/2006 | Grace et al. | 312/406 |
| 2010/0180626 | A1 | * | 7/2010 | Ahn et al. | 62/449 |
| 2010/0231110 | A1 | * | 9/2010 | Choi | 312/405 |

FOREIGN PATENT DOCUMENTS

| | | | | | |
|---|---|---|---|---|---|
| JP | 08068590 | A | * | 3/1996 | F25D 23/06 |
| JP | 8-254386 | | | 10/1996 | |
| JP | 9-152261 | | | 6/1997 | |
| JP | 11304353 | A | * | 11/1999 | F25D 23/06 |
| JP | 2001082866 | A | * | 3/2001 | F25D 23/02 |

* cited by examiner

*Primary Examiner* — Janet M Wilkens
*Assistant Examiner* — Andrew Roersma
(74) *Attorney, Agent, or Firm* — Staas & Halsey LLP

(57) ABSTRACT

A refrigerator includes a hinge bracket that is installed on a cabinet between an upper door and a lower door, which are configured to individually open and close an upper portion and a lower portion of a cabinet, respectively, and rotatably supports the upper door and the lower door, the hinge bracket coupled to a connecting member through a reinforcing bracket, which is installed at an inner side of a wall forming a heat insulation space of the cabinet, thereby enhancing the sealing performance of a filler unit configured to seal between the upper door and the lower door.

13 Claims, 9 Drawing Sheets

REFRIGERATOR

CROSS-REFERENCE TO RELATED APPLICATIONS

This application claims the priority benefit of Korean Patent Application No. 10-2011-0023964, filed on Mar. 17, 2011 in the Korean Intellectual Property Office, the disclosure of which is incorporated herein by reference.

BACKGROUND

1. Field

The following description relates to a refrigerator having a pillar unit capable of sealing a gap between a pair of doors, which are rotatably installed on a cabinet while individually opening and closing an upper portion and a lower portion of a storage compartment.

2. Description of the Related Art

In general, a refrigerator is an apparatus configured to store food by providing low-temperature, cool air to a storage compartment where the food is stored. The refrigerator includes a freezer compartment maintaining a temperature below the freezing point of water and a refrigerator compartment maintaining a temperature a few degrees above the freezing point.

Cool air is generated through a heat exchange of a refrigerant, and is continuously provided to the inside of the refrigerator through repeating a cooling cycle that includes compression, condensation, expansion, and evaporation. The cool air provided is equally distributed in the refrigerator such that food in the refrigerator is stored at a desired temperature.

In recent years, a large-size refrigerator has become available in the open market to meet the demand for the convenience of a user and storage space.

Various types of refrigerators include a normal type refrigerator having a freezer compartment at an upper portion of the refrigerator, a side-by-side refrigerator having a freezer compartment at a left or right side of the refrigerator, and a combination type refrigerator having a freezer compartment at a lower portion of the refrigerator.

Such a large-size refrigerator has a spacious storage compartment. When doors configured to open and close the storage compartment are open, the entire space of the storage compartment is open and thus a great amount of cool air is leaking, thereby degrading the cooling efficiency. Accordingly, there is a need for a door structure capable of preventing loss of cool air.

SUMMARY

Therefore, it is an aspect of the present disclosure to provide a refrigerator capable of reducing loss of cool air when opening doors that are configured to individually open and close an upper portion and a lower portion of a storage compartment.

Additional aspects of the disclosure will be set forth in part in the description which follows and, in part, will be obvious from the description, or may be learned by practice of the disclosure.

In accordance with one aspect of the present disclosure, a refrigerator may include a cabinet, an upper door and a lower door, a pillar unit, an upper hinge part, a lower hinge part, a hinge bracket, and a reinforcing bracket. The cabinet includes an inner case, which is laterally divided by a vertical partition wall to form a cooling compartment and a freezer compartment, and an outer case, which is disposed on an outer side of the inner case while interposing a heat insulation space, in which thermal insulating material is formed, between the outer case and the inner case. The upper door and the lower door are rotatably installed on the cabinet to independently open and close an upper portion and a lower portion of the cooling compartment while dividing the cooling compartment into the upper portion and the lower portion. The pillar unit is rotatably installed at either of the upper door or the lower door to seal a gap between the upper door and the lower door. The upper hinge part is configured to rotatably support an upper portion of the upper door. The lower hinge part is configured to rotatably support a lower portion of the lower door. The hinge bracket is disposed between the upper door and the lower door, comprising an upper hinge pin and a lower hinge pin, which are configured to rotatably support a lower portion of the upper door and an upper portion of the lower door, respectively, and coupled to an outer surface of the outer case. The reinforcing bracket is provided on an inner surface of the outer case while being coupled to the hinge bracket such that rigidity of the hinge bracket is reinforced. The hinge bracket includes a lateral side plate supported by a lateral side of the cabinet, a front-side plate bentedly extending from the lateral side plate and supported by a front side of the cabinet and a hinge plate through which the upper hinge pin and the lower hinge pin protrude.

The reinforcing bracket includes a lateral side support part, which is coupled to a connecting member that passes through the lateral side plate, and a front side support part, which bentedly extends from the lateral side support part and is coupled to a connecting member that passes through the front side plate.

The pillar unit includes a pillar member coupled at either of the upper door or the lower door as to enable a rotation in a vertical direction and provided at one end thereof with a guide protrusion, a pillar guide installed onto a side of the vertical partition wall and having a guide groove, to which the guide protrusion is inserted, such that the rotation of the pillar member is guided, and a torsion spring configured to elastically support the pillar member in a state that the pillar member is rotated upward by the pillar guide.

The front-side plate has a width corresponding to a front edge of the cabinet.

The reinforcing bracket includes metal provided in a shape of a plate, is coupled to an inner side of the outer case, and is supported by the thermal insulating material formed in the heat insulation space.

A plurality of shelves are disposed on the upper portion of the cooling compartment which is opened and closed by the upper door, and a plurality of drawers are disposed over the lower portion of the cooling compartment which is opened and closed by the lower door.

A front surface of each of the drawers is disposed to be adjacent to a rear surface of the lower door in a state that the lower door is closed.

A hinge bracket accommodating part is formed in the outer surface of the outer case while being recessed from the outer surface to the inner surface of the outer case.

The refrigerator further includes a hinge bracket cover configured to be coupled to the outer surface of the outer case such that the hinge bracket accommodating part is covered, and an outer surface of the hinge bracket cover is coplanar with the outer surface of the outer case.

In accordance with another aspect of the present disclosure, a refrigerator may include a cabinet, an upper door and a lower door, a pillar unit, a hinge bracket and a reinforcing bracket. The cabinet includes storage compartments divided by a vertical partition wall, an outer case, an inner case disposed inside the outer case to form the storage compartments, and thermal insulating material filled in a heat insulation space between the outer case and the inner case. The upper door and a lower door are rotatably installed on the cabinet to independently open and close an upper portion and a lower portion of one of the storage compartments while dividing the one storage compartment into the upper portion and the lower portion. The pillar unit is rotatably installed at a lower edge of the upper door to seal a gap between the upper door and the lower door. The hinge bracket is provided between the upper door and the lower door and coupled to the outer case through a connecting member to rotatably support a lower end of the upper door and an upper end of the lower door. The reinforcing bracket is installed onto an inner side of a wall forming the heat insulation space and coupled to the connecting member such that rigidity of the hinge bracket is reinforced.

The hinge bracket includes a lateral side plate, which is supported by a lateral side of the cabinet, a front-side plate, which bentedly extends from the lateral side plate and is supported by a front side of the cabinet, and a hinge plate, which extends from the front-side plate forward and has an upper hinge pin and a lower hinge pin axially coupled to the upper door and the lower door, respectively.

The reinforcing bracket comprises a lateral side support part, which is supported by an inner side of the outer case corresponding to the later side plate and is coupled to the connecting member, and a front-side support part, which bentedly extends from the lateral side support part and is coupled to a connecting member coupled to the front-side plate.

The pillar unit includes a pillar member rotatably coupled to the upper door and provided at one end thereof with a guide protrusion, a pillar guide installed onto a side of the vertical partition wall and having a guide groove, to which the guide protrusion is inserted, such that the rotation of the pillar member is guided, and a torsion spring configured to elastically support the pillar member in a state that the pillar member is rotated upward by the pillar guide.

As described above, the refrigerator according to the embodiment of the present disclosure can prevent loss of cool air caused by opening and closing a storage compartment, and also can enhance the sealing performance of the storage compartment.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
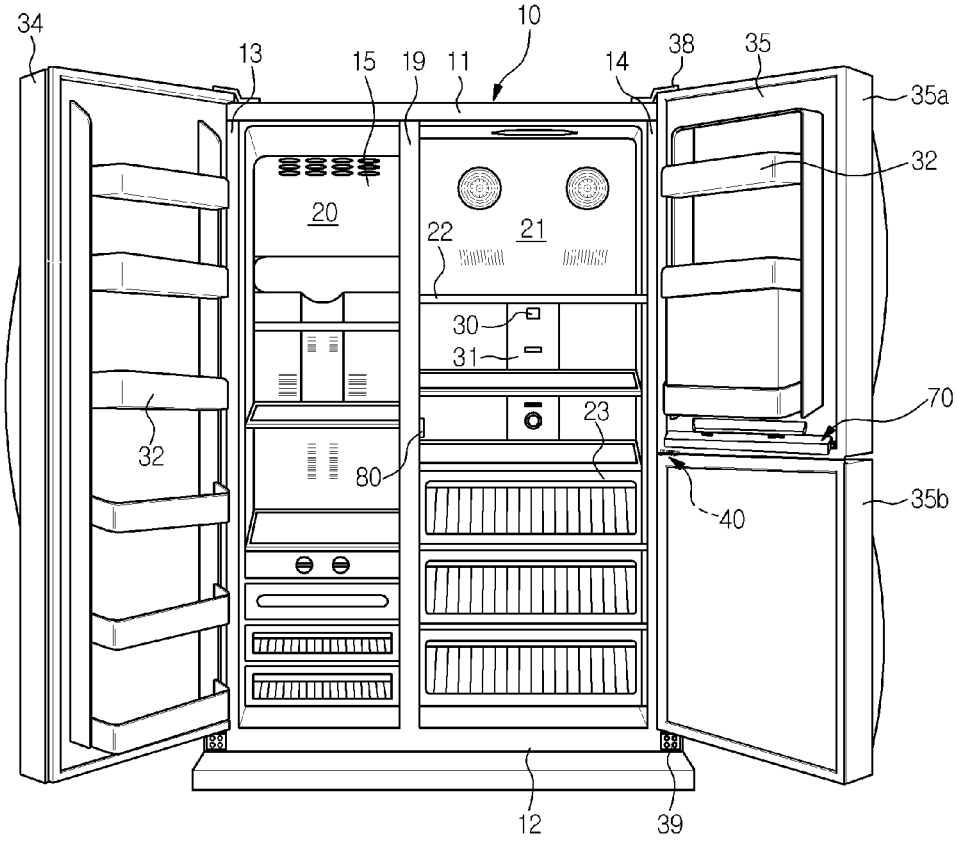
FIG. 1 is a view illustrating an opening state of a refrigerator according to an embodiment of the present disclosure.

Reference will now be made in detail to the embodiments of the present disclosure, examples of which are illustrated in the accompanying drawings, wherein like reference numerals refer to like elements throughout.

Figure 2:
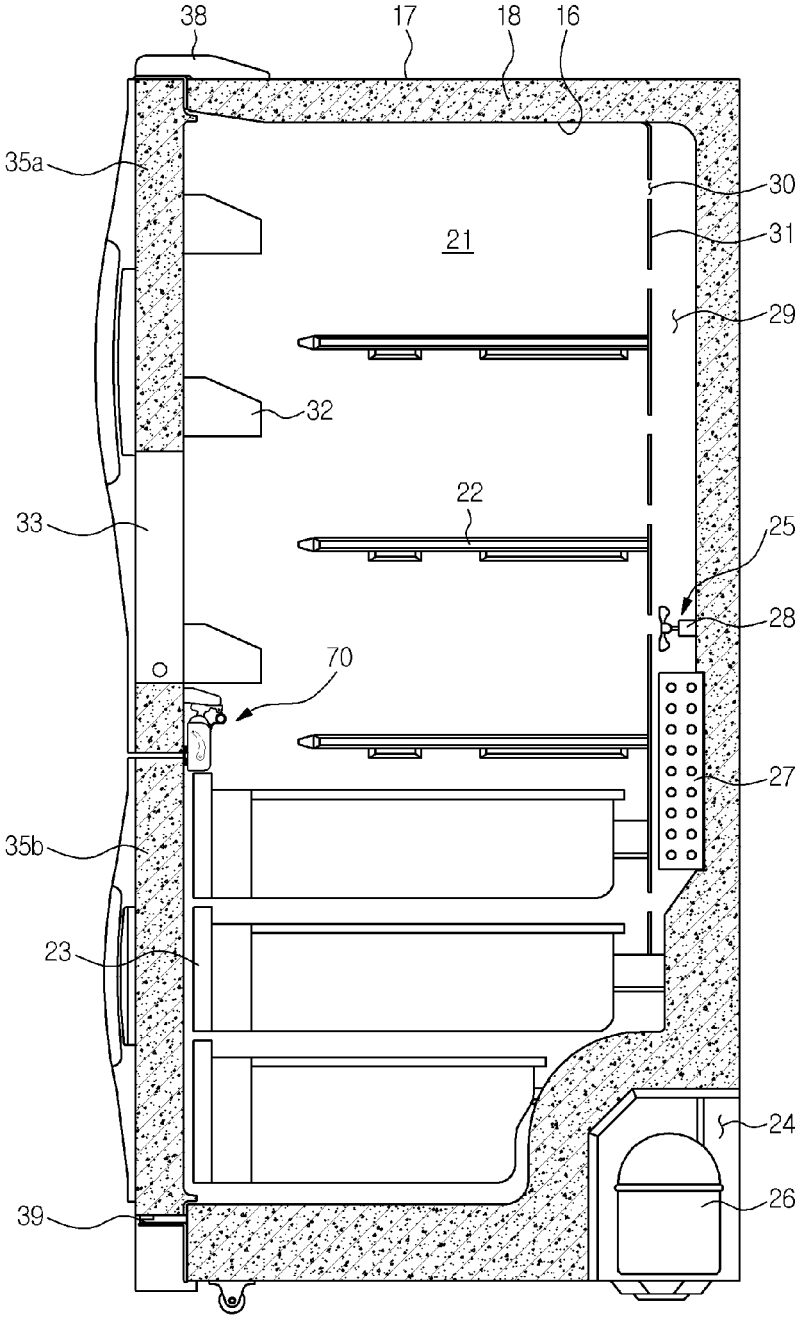
FIG. 2 is a cross-sectional view showing the refrigerator according to the embodiment of the present disclosure.

FIG. 1 is a view illustrating an open state of a refrigerator according to an embodiment of the present disclosure. FIG. 2 is a cross-sectional view showing the refrigerator according to the embodiment of the present disclosure.

Referring to FIGS. 1 and 2, a refrigerator according to an embodiment of the present disclosure includes a cabinet 10 having a plurality of storage compartments 20 and 21 divided from each other, doors 34 and 35 provided on the front surfaces of the storage compartments 20 and 21 to open and close the storage compartments 20 and 21, a cool air supply device 25 provided in each of the storage compartments 20 and 21 to supply cool air to the inside of the storage compartments 20 and 21, and a machine compartment 24 provided on a rear side of a lower portion of the cabinet 10 and configured to mount electronic parts such as a compressor 26, for example.

In addition, the refrigerator includes a cooling cycle which is provided to generate the cool air that is to be discharged through the cool air supply device 25. The cooling cycle is formed by a compressor 26, a condenser (not shown), an expander (not shown), and an evaporator 27.

The cabinet 10 includes an inner case 16 forming the storage compartments 20 and 21, and an outer case 17 disposed on an outer side of the inner case 16 to form an external appearance of the refrigerator. Thermal insulating material 18 is formed between the inner case 16 and the outer case 17 to maintain heat insulation of the storage compartments 20 and 21. The external appearance of the cabinet 10 is formed by an upper side wall 11, a lower side wall 12, a left side wall 13, a right side wall 14, and a rear side wall 15. The storage compartments 20 and 21 are divided by a vertical partition wall 19 vertically formed in the cabinet 10.

The storage compartments 20 and 21 laterally divided by the vertical partition wall 19 include a freezer compartment 20 and a cooling compartment 21, provided on a left side and a right side, respectively. Each of the storage compartments 20 and 21 may have a shelf 22 to place food thereon and a drawer 23 to accommodate foods.

The doors 34 and 35 are provided on the front surfaces of the cooling compartment 21 and the freezer compartment 20 to open and close the cooling compartment 21 and the freezer compartment 20. The doors 34 and 35 include a freezer compartment door 34 rotatably hinged to the left side wall 13 of the cabinet 10, and a cooling compartment door 35 rotatably hinged to the right side wall 14 of the cabinet 10. In addition, a plurality of door guards 32 are provided on a rear surface of each of the doors 34 and 35 while being spaced apart from each other to load small-volume products.

A subsidiary door 33, which is openable, may be installed onto the cooling compartment door 35 to enable the product in the cooling compartment 21 to be withdrawn from the front side of the refrigerator without having to open the cooling compartment door 35.

The cool air supply device 25, which generates cool air by use of heat exchange of refrigerant that circulates while forming a cooling cycle, is provided on an inner side of the rear side wall 15 of the storage compartments 20 and 21. The cool air supply device 25 includes the evaporator 27, which is configured to cool ambient air by evaporating a refrigerant passing through the compressor 26, and a blower 28 to forcedly provide the cooled air around the evaporator 27 to the storage compartments 20 and 21.

The evaporator 27 is installed onto a cool air passage 29 that is disposed on a rear side of the storage compartments 20 and 21. The cool air passage 29 is formed in a cool air duct 31 that is provided on the rear side wall 15 of the cabinet 10 and has a plurality of cool air discharge holes 30. The cool air discharged through the cool air discharge holes 30 cools the storage compartments 20 and 21 and then flows toward the evaporator 27.

Meanwhile, as a user opens the doors 34 and 35 to open the storage compartments 20 and 21, the cool air in the storage compartments 20 and 21 is rapidly discharged to the outside from the storage compartments 20 and 21, which have a relatively large space, causing a loss of cool air. In order to prevent such a loss of cool air, the doors 34 and 35, according to the embodiment of the present disclosure, are configured to separately open and close an upper portion and a lower portion of each of the storage compartments 20 and 21. Because the configuration of separately opening and closing an upper portion and a lower portion of each of the storage compartments 20 and 21 is identical with the freezer compartment door 34 and the cooling compartment door 35, the following description will be made in relation to the cooling compartment door 35 to open and close the cooling compartment 21 as an example that may be more frequently used than the freezer compartment door 34. The cooling compartment door 35 includes an upper door 35*a* to open and close an upper space of the cooling compartment 21 and a lower door 35*b* to open and close a lower space of the cooling compartment 21.

The upper door 35*a* and the lower door 35*b* are rotatably coupled to the right side wall 14 of the cabinet 10 to independently open and close the upper portion and the lower portion of the cooling compartment 21, thereby preventing cool air from being lost due to the entire cooling compartment 21 being open.

A plurality of shelves 22 may be vertically disposed in the upper portion of the cooling compartment 21 opened and closed by the upper door 35*a* while being spaced apart from one another. A plurality of drawers 23 may be vertically provided at the lower portion of the cooling compartment 21 opened and closed by the lower door 35*b*.

The plurality of drawers 23 is provided to occupy the entire space of the lower portion of the cooling compartment 21 opened and closed by the lower door 35*b* to prevent cool air of the upper space of the cooling compartment 21 from being discharged to the outside when the lower door 35*b* is open.

To this end, the longitudinal side of the drawer 23 along the advancing direction of the drawer 23 is substantially identical to or smaller than the longitudinal side of the cooling compartment 21 along the front side to the rear side of the cooling compartment 21 such that a front surface of the drawer 23 is disposed to be adjacent to a rear surface of the lower door 35*b*. In addition, the rear surface of the lower door 35*b* does not have the door guard 32 such that the maximum longitudinal side of the drawer 23 is maximized to increase the accommodation capacity while minimizing the amount of cool air between the front surface of the drawer 23 and the rear surface of the lower door 35*b* when the upper door 35*a* is open.

That is, the plurality of shelves 22 is disposed in the upper space of the cooling compartment 21 opened and closed by the upper door 35*a*, and the plurality of drawers 23 is disposed in the lower space of the cooling compartment 21 opened and closed by the lower door 35*b*, thereby enhancing the spatial efficiency of the cooling compartment 21 and reducing the loss of cool air. In addition, a user may easily learn the position where food is placed, thereby removing the inconvenience of opening and closing the doors 35*a* and 35*b* unnecessarily.

An upper hinge part 38 is coupled to an upper portion of the right side wall 14 of the cabinet 10 while rotatably supporting an upper portion of the upper door 35*a*. A lower hinge part 39 is coupled to a lower portion of the right side wall 14 of the cabinet 10 while rotatably supporting a lower portion of the lower door 35*b*.

In addition, a hinge bracket 40 is installed at a middle portion of the right side wall 14 of the cabinet 10 between the upper door 35*a* and the lower door 35*b* to rotatably support a lower portion of the upper door 35*a* and an upper portion of the lower door 35*b*.

The refrigerator according to the embodiment of the present disclosure does not require a thermal insulating wall configured to vertically divide the cooling compartment 21 into the upper portion and the lower portion. Accordingly, the hinge bracket 40 rotatably supporting the upper door 35*a* and the lower door 35*b* needs to have a great rigidity sufficient to stand the deadweight of the upper door 35*a*. The structure of hinge bracket 40 will be described later in detail.

Meanwhile, a pillar unit 70 is rotatably installed on the lower portion of the upper door 35*a* to seal a gap that is formed between the lower portion of the upper door 35*a* and the upper portion of the lower door 35*b*.

Figure 3:
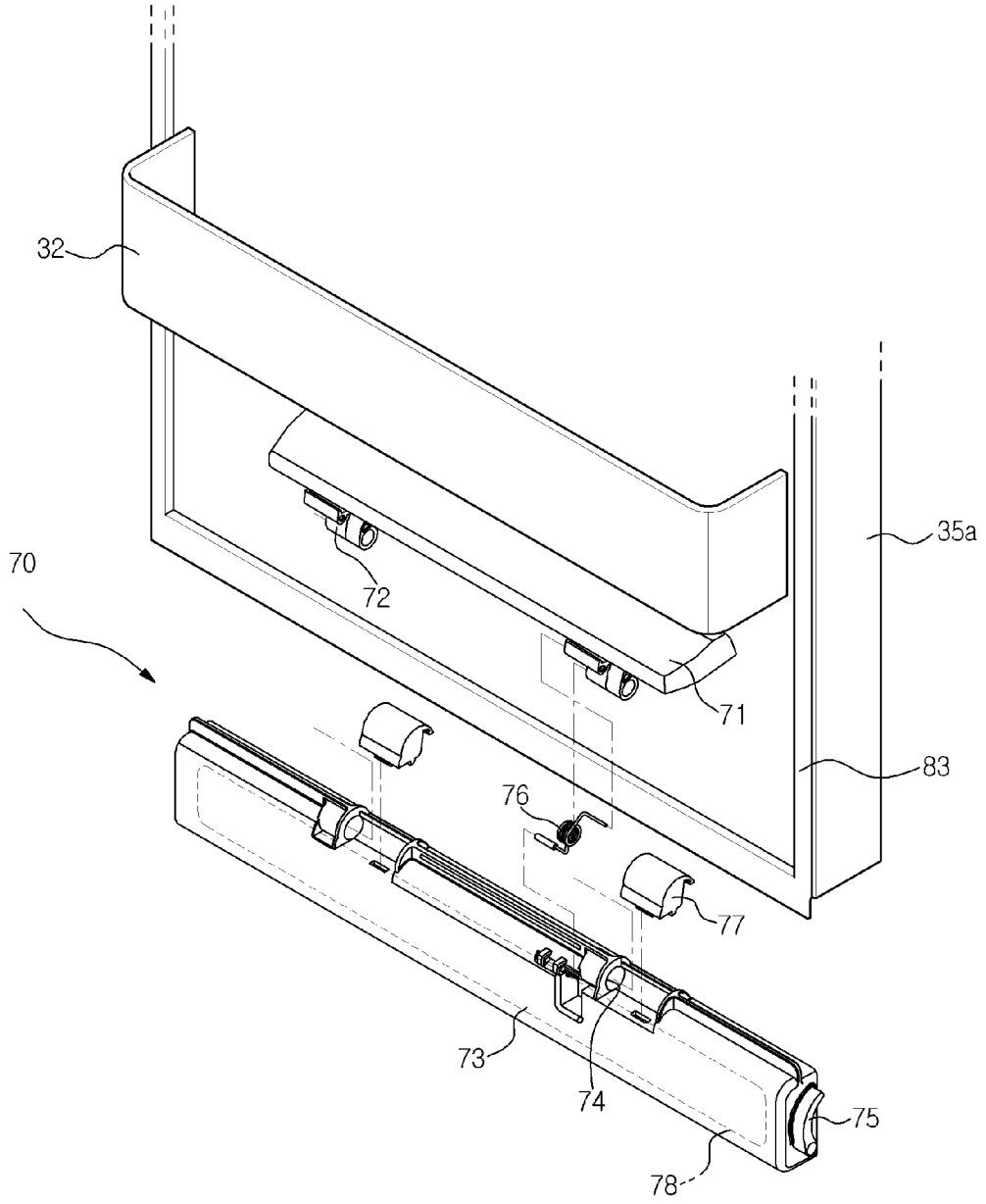
FIG. 3 is an exploded perspective view illustrating a pillar unit provided on a rear surface of a door of the refrigerator according to the embodiment of the present disclosure.
Figure 4:
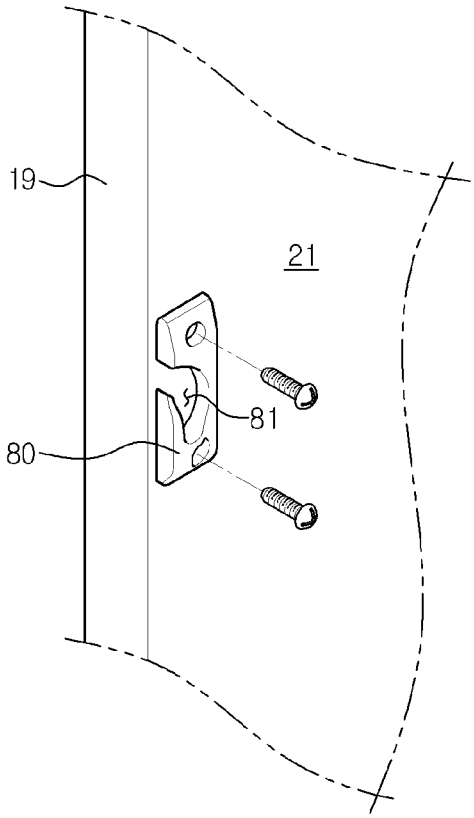
FIG. 4 is a perspective view illustrating a pillar guide for the pillar unit of the refrigerator according to the embodiment of the present disclosure.
Figure 5:
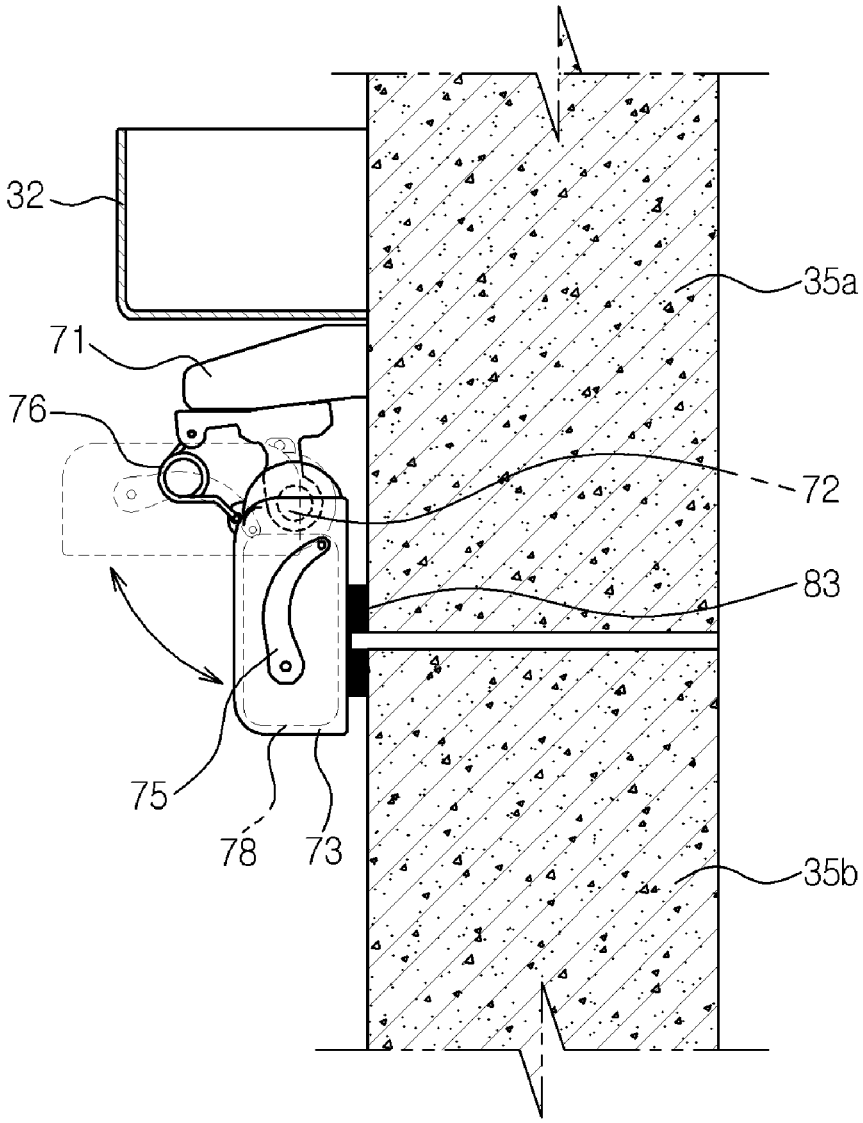
FIG. 5 is a view showing the operation of the pillar unit of the refrigerator according to the embodiment of the present disclosure.

FIG. 3 is an exploded perspective view illustrating the pillar unit provided on the rear surface of the lower door 35*b* of the refrigerator according to the embodiment of the present disclosure. FIG. 4 is a perspective view illustrating a pillar guide for the pillar unit of the refrigerator according to the embodiment of the present disclosure. FIG. 5 is a view showing the operation of the pillar unit of the refrigerator according to the embodiment of the present disclosure.

Referring to FIGS. 3 and 4, the pillar unit 70 is configured to seal the gap between the upper door 35*a* and the lower door 35*b* to prevent cool air from leaking. The pillar unit 70 is formed lengthwise along the width of the cooling compartment 21, and accommodates a pillar member 73 including a thermal insulating material or Expanded Polystyrene (EPS) having a thermal insulating function. The pillar member 73 is axially coupled to a rotation axis of a pillar bracket 71, which is provided at a lower portion of the rear surface of the upper door 35*a*, to enable rotation in a vertical direction. In addition, the pillar member 73 is provided on an inner side thereof with a heating wire 78, which is connected to the machine part in the cabinet by passing through the upper door 35*a*, to prevent moisture condensation from occurring due to the difference in temperature between the inside and outside of the pillar member 73.

The rotation axis 72 extends downward from each of the end portions of a lower surface of the pillar bracket 71 such that the rotation axis 72 is coupled to an axis coupling hole 74 of the pillar member 73. In addition, a torsion spring 76 is installed onto a lateral side of the axis coupling hole 74 to press the pillar member 73 upward. One end of the torsion spring 76 is supported by the pillar member 73, and the other end of the torsion spring 76 is supported by the pillar bracket 71. Reference numeral 77 denotes a cover member that is detachably disposed at a lateral side of the rotation axis 72 to prevent the rotation axis 72 from being separated.

In order for the pillar member 73 to vertically rotate according to the opening and closing operation of the upper door 35*a*, a guide protrusion 75 is formed at one end of the pillar member 73 and a pillar guide 80 having a guide groove 81 configured to guide the guide protrusion 75 is installed to an inner surface of the cooling compartment 21 corresponding to the position of the guide protrusion 75 when the upper door 35*a* is closed, that is, on a side of the vertical partition wall 19.

While the upper door 35*a* is being closed, the guide protrusion 75 is inserted into the guide groove 81 such that the guide protrusion 75 rotates downward along with the shape of the guide groove 81 such that the pillar member 73 rotates from a horizontal state to a vertical state as shown in FIG. 5. As a result, the pillar member 73 comes into close contact with a gasket 83 provided over an edge of the upper door 35*a* and the lower door 35*b*, thereby sealing the gap between the upper door 35*a* and the lower door 35*b*.

In addition, a portion of the gasket 83 making contact with the pillar member 73, that is, a portion of the gasket 83 corresponding to the lower portion of the upper door 35*a*, and the upper portion of the lower door 35*b* expand to cover a gap between the pillar member 73 and the cooling compartment 21, thereby preventing cool air from leaking through the gap.

While the upper door 35*a* is being opened, the guide protrusion 75 of the pillar member 73 moves along the guide groove 81, and the pillar member 73 rotates upward, and returns to the horizontal state. At this time, the torsion spring 76 coupled to the rotation axis 72 presses the pillar member 73 such that the pillar member 73 maintains its horizontal state, thereby preventing the pillar member 73 from rotating downward and interfering with the lower door 35*b* when the upper door 35*a* is being closed.

The upper door 35*a* and the lower door 35*b* are configured to independently allow access to the upper portion and the lower portion of the cooling compartment 21, respectively. The lower portion of the upper door 35*a* and the upper portion of the lower door 35*b* are rotatably supported by the hinge bracket 40 that is installed between the upper door 35*a* and the lower door 35*b*.

The refrigerator according to the embodiment of the present disclosure does not require a thermal insulating wall, which may be configured to support the upper door 35*a* and the lower door 35*b* while vertically dividing the cooling compartment 21 into the upper portion and the lower portion. Accordingly, the hinge bracket 40 configured to rotatably support the upper door 35*a* receives the deadweight of the upper door 35*a* or an external force caused by frequent opening and closing of the upper door 34*a*. Long-term use may deform the hinge bracket 40, thereby causing the upper door 35*a* to droop.

The embodiment of the present disclosure provides a hinge bracket capable of preventing deformation of doors that are configured to vertically divide a storage space and individually open and close the divided storage space of the cooling compartment 21.

Figure 6:
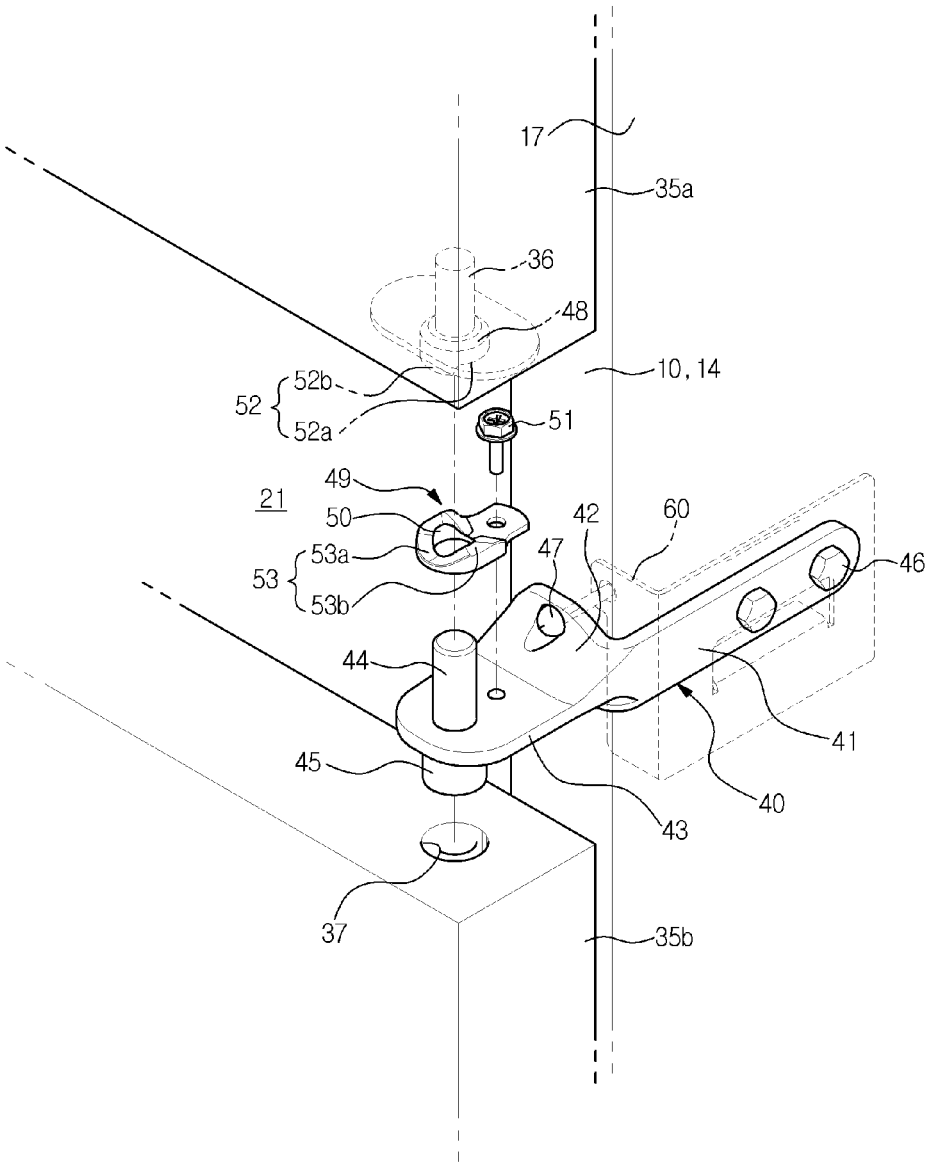
FIG. 6 is an exploded perspective view illustrating a hinge bracket that rotatably supports an upper door and a lower door of the refrigerator according to the embodiment of the present disclosure.
Figure 7:
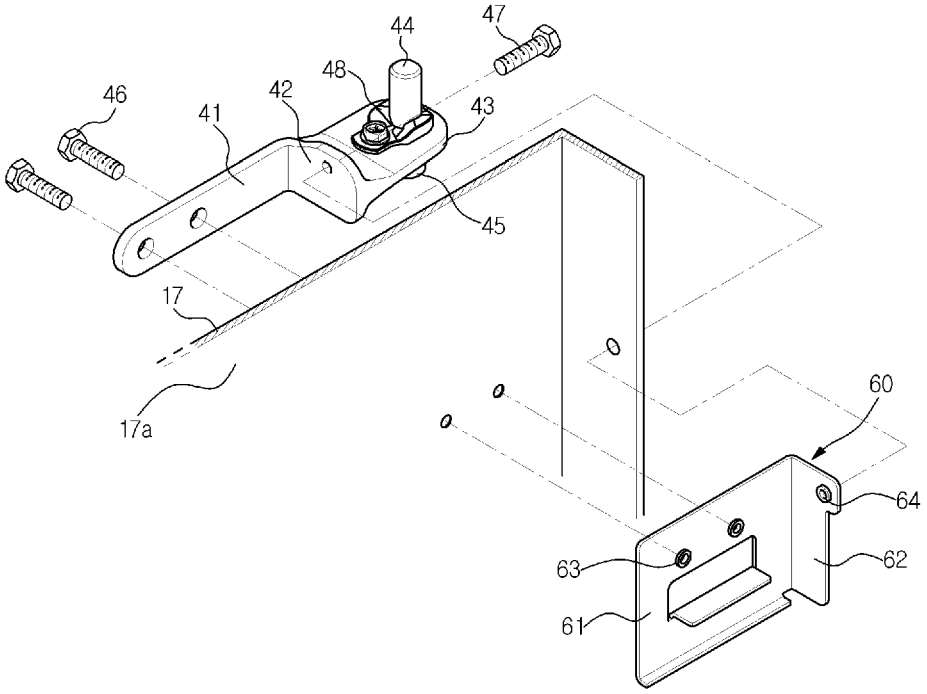
FIG. 7 is a view illustrating an installation structure of a reinforcing bracket of the refrigerator according to the embodiment of the present disclosure.
Figure 8:
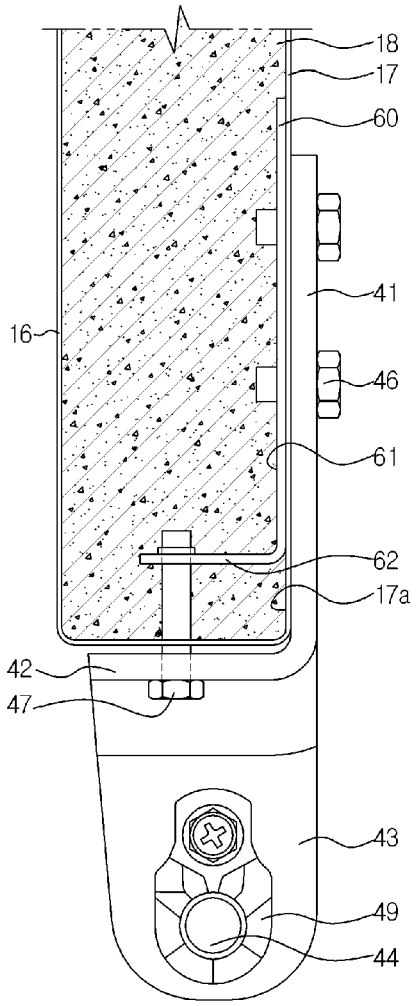
FIG. 8 is a view illustrating a state in which the hinge bracket is coupled to the reinforcing bracket of the refrigerator according to the embodiment of the present disclosure.

FIG. 6 is an exploded perspective view illustrating a hinge bracket that rotatably supports an upper door and a lower door of the refrigerator according to the embodiment of the present disclosure. FIG. 7 is a view illustrating an installation structure of a reinforcing bracket of the refrigerator according to the embodiment of the present disclosure. FIG. 8 is a view illustrating a state in which the hinge bracket is coupled to the reinforcing bracket of the refrigerator according to the embodiment of the present disclosure.

Referring to FIGS. 6 to 8, the hinge bracket 40 is coupled to an outer side of the right side wall 14 of the cabinet 10 while rotatably supporting the upper door 35*a* and the lower door 35*b*.

The hinge bracket 40 includes a lateral side plate 41 supported by a lateral side of the outer case 17 of the cabinet 10, a front-side plate 42 bentedly extending from a front end of the lateral side plate 41 and coupled to a front side of the cabinet 10, and a hinge plate 43 that extends forward from a planar surface of the front-side plate 42.

Each of the lateral side plate 41 and the front-side plate 42 is provided in a plate shape. The lateral side plate 41 comes into close contact with the lateral side of the cabinet 10 through a connecting member 46. The front-side plate 42 has a width corresponding to a width of an edge of the front side of the cabinet 10, and comes into contact with the edge of front side of the cabinet 10 through a connecting bolt 47.

The hinge plate 43 is provided with an upper hinge pin 44 and a lower hinge pin 45 which vertically extend from an upper surface and a lower surface of the hinge plate 43, respectively, while rotatably supporting the lower portion of the upper door 35*a* and the upper portion of the lower door 35*b*, respectively.

The upper hinge pin 44 extends from the upper surface of the hinge plate 43 to be axially coupled to an upper hinge hole 36 that is formed in the lower surface of the upper door 35*a*. The lower hinge pin 45 extends from the lower surface of the hinge plate 43 to be axially coupled to a lower hinge hole 37 that is formed in the upper surface of the lower door 35*b*.

A lower cam member 49 is provided on the upper surface of the hinge plate 43 such that the upper door 35*a* is automatically closed in a state that the upper door 35*a* is open less than or equal to a predetermined angle, and maintains its open angle in a state that the upper door 35*a* is open more than the predetermined angle. An upper cam member 48 is provided on the upper surface of the hinge plate 43 corresponding to the lower cam member 49 such that the upper cam member 48 performs a sliding motion by making contact with the lower cam member 49.

The lower cam member 49 has a pin insertion hole 50 allowing the upper hinge pin 44 to pass therethrough. The upper hinge pin 44 passing through the pin insertion hole 50 is coupled to the upper surface of the hinge plate 43 through a connecting screw 51.

The upper cam member 48 has a cam portion 52 including a plurality of grooves 52*a* and a plurality of protrusions 52*b*. The lower cam member 49 has a cam portion 53 including a plurality of grooves 53*a* and a plurality of protrusions 53*b* in which the groove 52*a* and the protrusion 52*b* are engaged with the protrusion 53*b* and the groove 53*a*, respectively. Accordingly, as the upper door 35*a* rotates, the upper cam member 48 rotates along with the upper door 35*a* while performing a sliding motion through the cam portions 52 and 53 in cooperation with the lower cam member 49, so that the upper door 35*a* moves up and down.

In this manner, the upper door 35*a* is automatically closed or maintains its open state depending on the open angle of the upper door 35*a* through the interworking of the cam portions 52 and 53.

Meanwhile, the hinge bracket 40, which continuously supports the lower portion of the upper door 35*a* such that the upper door 35*a* is rotatable, may be deformed due to the weight of the upper door 35*a* or an external force caused by the repeated open and close operation of the upper door 35*a*, and such a deformation of the hinge bracket 40 may distort a sealing structure of the doors 35*a* and 35*b*, thereby degrading the sealing performance of the cooling compartment 21.

In order to prevent the sealing performance from being degraded, a reinforcing bracket 60 may be installed on an inner surface 17*a* of the outer case 17, in which the thermal insulating material 18 is filled, to improve the reinforcing structure of the hinge bracket 40.

The reinforcing bracket 60 is primarily coupled to a position of the inner surface 17*a* of the outer case 17 corresponding to the hinge bracket 40 through a rivet process or an adhesion member before the thermal insulating member 18 is formed between the outer case 17 and the inner case 16, and then secondarily secured through the thermal insulating material 18.

The reinforcing bracket 60 includes a lateral side support part 61 and a front-side support part 62. The lateral side support part 61 is supported by a portion of the inner surface 17*a* of the outer case 17 which forms a lateral side of the cabinet, and includes a plate shape metal. The front-side support part 62 bentedly extends from a front end of the lateral side support part 61 to correspond to the edge of the front side of the cabinet 10.

The reinforcing bracket 60 including the lateral side support part 61 and the front-side support part 62 is formed by performing shearing and bending of a metal plate having a predetermined thickness and rigidity.

The lateral side support part 61 has a connecting member coupling hole 63 coupled to the connecting member 46 that is coupled to the lateral side plate 41 of the hinge bracket 40. The front-side support part 62 has a bolt coupling hole 64 coupled to the connecting bolt 47 that is coupled to the front-side plate 42 of the hinge bracket 40. In addition, the lateral side support part 61 comes into contact with the inner surface 17*a* of the outer case 17. The front-side support part 62 is spaced apart from the inner surface 17*a* of the outer case 17 by a predetermined interval. The lateral side support part 61 is provided in size and thickness that vary with the weight applied to the reinforcing bracket 60.

According to this configuration, the hinge bracket 40 makes contact with the cabinet 10 on a larger contact area, from being supported by the lateral side and the front side of the cabinet 10, and thus the stress applied to the hinge bracket 40 is distributed. In addition, the reinforcing bracket 60 reinforces the rigidity of the hinge bracket 40 and thus prevents the hinge bracket 40 from being easily deformed by the weight of the upper door 35*a* or an external force applied to the door. Such a secured coupling of the hinge bracket 40 to the cabinet 10 prevents the upper door 35*a* from drooping and preventing a contact area between the gasket 83 and the pillar unit 70 from being distorted, thereby enhancing the sealing performance of the cooling compartment 21.

Figure 9:
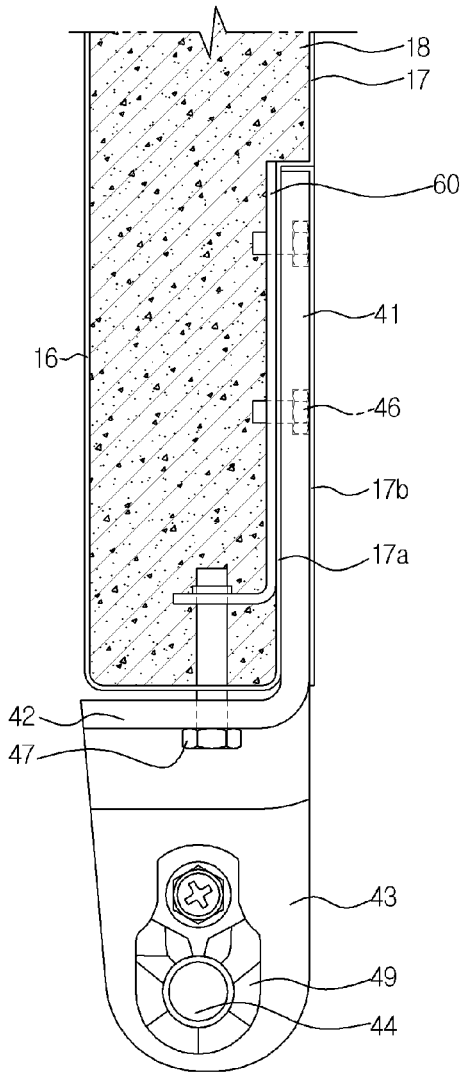
FIG. 9 is a cross-sectional view illustrating a coupling structure of a hinge bracket according to another embodiment of the present disclosure.

FIG. 9 is a cross-sectional view illustrating a coupling structure of a hinge bracket according to another embodiment of the present disclosure. In the following description, a part having the same function as that of the previous embodiment will be assigned the same reference numeral as the previous embodiment and the description of the same part will be omitted in order to avoid redundancy.

Referring to FIG. 9, the hinge bracket 40 according to another embodiment of the present disclosure is coupled to the outer surface of the cabinet 10 without protruding beyond the outer surface of the outer case 17 to improve the aesthetic quality of the refrigerator.

To this end, a hinge bracket accommodating part 17*a* is formed in a position of the outer surface of the outer case 17, the position coupled to the lateral side plate 41, to be recessed inward from the outer surface of the outer case 17. A hinge bracket cover 17*b* is coupled to the hinge bracket accommodating part 17*a* while covering the hinge bracket accommodating part 17*a* in a state that the lateral side plate 41 is accommodated in the hinge bracket accommodating part 17*a*.

When the hinge bracket cover 17*b* is coupled to the outer surface of the outer case 17, the outer surface of the outer case 17 does not have a step difference with an outer surface of the hinge bracket cover 17*b*, that is, the outer surface of the outer case 17 is coplanar with the outer surface of the hinge bracket cover 17*b*.

As described above, the hinge bracket 40 is provided to be contained in the outer case 17 without protruding beyond the outer surface of the outer case 17, thereby improving the aesthetic quality of the refrigerator.

Although not shown in the drawing, a slit part may be formed in the outer case 17 to be open corresponding to the lateral side plate 41. The lateral side plate 41 is inserted into the slit part to be coupled to the reinforcing bracket 60, which is coupled to an inner side of a wall forming a space for the thermal insulating material 18, so that the outer surface of the lateral side plate 41 of the hinge bracket 60 is coplanar with the outer surface of the outer case 17.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a cabinet comprising an inner case, which is laterally divided by a vertical partition wall to form a cooling compartment and a freezer compartment, and an outer case, which is disposed on an outer side of the inner case while interposing a heat insulation space, in which thermal insulating material is formed, between the outer case and the inner case;

an upper door and a lower door rotatably installed on the cabinet to independently open and close an upper portion and a lower portion of the cooling compartment while dividing the cooling compartment into the upper portion and the lower portion, the cooling compartment being configured not to have any horizontal partition wall;

a pillar unit rotatably installed at either of the upper door or the lower door to seal a gap between the upper door and the lower door;

an upper hinge part configured to rotatably support an upper portion of the upper door;

a lower hinge part configured to rotatably support a lower portion of the lower door;

a hinge bracket disposed between the upper door and the lower door, comprising an upper hinge pin and a lower hinge pin, which are configured to rotatably support a lower portion of the upper door and an upper portion of the lower door, respectively, and coupled directly to an outer surface of the outer case; and a reinforcing bracket provided on an inner surface of the outer case while being coupled to the hinge bracket such that rigidity of the hinge bracket is reinforced, wherein the hinge bracket comprises a lateral side plate supported by a lateral side of the cabinet, a front side plate bentedly extending from the lateral side plate and supported by a front side of the cabinet, and a hinge plate through which the upper hinge pin and the lower hinge pin protrude, and wherein the reinforcing bracket comprises a lateral side support part, which is coupled to a connecting member that passes through the lateral side plate, and a front side support part, which bentedly extends from the lateral side support part and is coupled to a connecting member that passes through the front side plate, so that both of the hinge bracket and the reinforcing bracket are coupled to the lateral side and the front side of the cabinet.

2. The refrigerator of claim 1, wherein the pillar unit comprises a pillar member coupled at either of the upper door or the lower door as to enable a rotation in a vertical direction and provided at one end thereof with a guide protrusion, a pillar guide installed onto a side of the vertical partition wall and having a guide groove, to which the guide protrusion is inserted, such that the rotation of the pillar member is guided, and a torsion spring configured to elastically support the pillar member in a state that the pillar member is rotated upward by the pillar guide.

3. The refrigerator of claim 1, wherein the front side plate has a width corresponding to a front edge of the cabinet.

4. The refrigerator of claim 1, wherein the reinforcing bracket comprises metal provided in a shape of a plate, is coupled to an inner side of the outer case, and is supported by the thermal insulating material formed in the heat insulation space.

5. The refrigerator of claim 1, wherein a plurality of shelves are disposed on the upper portion of the cooling compartment which is opened and closed by the upper door, and a plurality of drawers are disposed over the lower portion of the cooling compartment which is opened and closed by the lower door.

6. The refrigerator of claim 5, wherein a front surface of each of the drawers is disposed to be adjacent to a rear surface of the lower door in a state that the lower door is closed.

7. The refrigerator of claim 5, wherein a hinge bracket accommodating part is formed in the outer surface of the outer case while being recessed from the outer surface to the inner surface of the outer case.

8. The refrigerator of claim 7, further comprising a hinge bracket cover configured to be coupled to the outer surface of the outer case such that the hinge bracket accommodating part is covered, and an outer surface of the hinge bracket cover is coplanar with the outer surface of the outer case.

9. A refrigerator comprising:

a cabinet comprising storage compartments divided by a vertical partition wall, an outer case, an inner case disposed inside the outer case to form the storage compartments, and thermal insulating material filled in a heat insulation space between the outer case and the inner case;

an upper door and a lower door that are rotatably installed on the cabinet to independently open and close an upper portion and a lower portion of one of the storage compartments while dividing the one storage compartment into the upper portion and the lower portion, the one storage compartment being configured not to have any horizontal partition wall;

a pillar unit rotatably installed at a lower edge of the upper door to seal a gap between the upper door and the lower door;

a hinge bracket provided between the upper door and the lower door and coupled directly to the outer case with a connecting member to rotatably support a lower end of the upper door and an upper end of the lower door; and a reinforcing bracket installed onto an inner side of a wall forming the heat insulation space and coupled to the connecting member such that rigidity of the hinge bracket is reinforced, wherein the hinge bracket comprises a lateral side plate, which is supported by a lateral side of the cabinet, a front side plate, which bentedly extends from the lateral side plate and supported by a front side of the cabinet, and a hinge plate, which extends from the front side plate forward and has an upper hinge pin and a lower hinge pin axially coupled to the upper door and the lower door, respectively, and wherein the reinforcing bracket comprises a lateral side support part, which is supported by an inner side of the outer case corresponding to the lateral side plate and is coupled to the connecting member, and a front side support part, which bentedly extends from the lateral side support part and is coupled to a connecting member coupled to the front side plate, so that both of the hinge bracket and the reinforcing bracket are coupled to the lateral side and the front side of the cabinet.

10. The refrigerator of claim 9, wherein the pillar unit comprises a pillar member rotatably coupled to the upper door and provided at one end thereof with a guide protrusion, a pillar guide installed onto a side of the vertical partition wall and having a guide groove, to which the guide protrusion is inserted, such that the rotation of the pillar member is guided, and a torsion spring configured to elastically support the pillar member in a state that the pillar member is rotated upward by the pillar guide.

11. The refrigerator of claim 10, wherein the pillar unit further comprises a heating wire.

12. A system to independently allow access to at least two portions of a refrigerated storage cabinet, the system comprising:

the refrigerated storage cabinet being configured not to have any horizontal partition wall;

a first door to provide access to a first portion of the cabinet;

a second door installed adjacent to the first door to provide access to a second portion of the cabinet;

a hinge bracket installed between the first door and the second door, and coupled to an exterior surface of the cabinet to rotatably support the first door and the second door;

a reinforcing bracket installed on an interior surface of the cabinet and coupled to the hinge bracket by a connecting member to reinforce the hinge bracket; and a pillar unit rotatably installed on an interior surface of the first door to seal a gap between the first door and the second door when the first door and the second door are in a closed position, wherein the second door operates independently from the first door, wherein the hinge bracket comprises a lateral side plate supported by a lateral side of the cabinet, a front side plate bentedly extending from the lateral side plate and supported by a front side of the cabinet, and a hinge plate through which an upper hinge pin and a lower hinge pin protrude, and wherein the reinforcing bracket comprises a lateral side support part, which is coupled to a connecting member that passes through the lateral side plate, and a front side support part, which bentedly extends from the lateral side support part and is coupled to a connecting member that passes through the front side plate, so that both of the hinge bracket and the reinforcing bracket are coupled to the lateral side and the front side of the cabinet.

13. The system of claim 12, the system further comprising:

a subsidiary door mounted on the first door to provide access to the first portion of the cabinet without opening the first door.

* * * * *